US007926571B2

(12) United States Patent
Hofman

(10) Patent No.: US 7,926,571 B2
(45) **Date of Patent: *Apr. 19, 2011**

(54) CEMENTED OPEN HOLE SELECTIVE FRACING SYSTEM

(75) Inventor: Raymond A. Hofman, Midland, TX (US)

(73) Assignee: Raymond A. Hofman, Midland, TX (US)

( * ) Notice: Subject to any disclaimer, the term of this patent is extended or adjusted under 35 U.S.C. 154(b) by 147 days.

This patent is subject to a terminal disclaimer.

(21) Appl. No.: 11/760,728

(22) Filed: Jun. 8, 2007

(65) Prior Publication Data

US 2008/0302538 A1 Dec. 11, 2008

(51) Int. Cl.
*E21B 34/06* (2006.01)

(52) U.S. Cl. ..... 166/373; 166/318; 166/369

(58) Field of Classification Search ..... 166/369, 166/373, 318

See application file for complete search history.

(56) References Cited

U.S. PATENT DOCUMENTS

| | | | | |
|---|---|---|---|---|
| 5,381,862 | A * | 1/1995 | Szarka et al. | 166/212 |
| 5,669,448 | A * | 9/1997 | Minthorn et al. | 166/308.1 |
| 5,894,888 | A | 4/1999 | Wiemers et al. | |
| 6,176,312 | B1 * | 1/2001 | Tubel et al. | 166/250.15 |
| 6,196,312 | B1 * | 3/2001 | Collins et al. | 166/265 |
| 6,446,727 | B1 | 9/2002 | Zemlak et al. | |
| 6,460,619 | B1 | 10/2002 | Braithwaite et al. | |
| 6,907,936 | B2 | 6/2005 | Fehr et al. | |
| 7,021,384 | B2 | 4/2006 | Themig et al. | |
| 7,096,954 | B2 | 8/2006 | Weng et al. | |
| 7,108,060 | B2 | 9/2006 | Jones | |
| 7,108,067 | B2 | 9/2006 | Themig et al. | |
| 7,225,869 | B2 * | 6/2007 | Willett et al. | 166/280.1 |
| 7,267,172 | B2 * | 9/2007 | Hofman | 166/281 |
| 2006/0124310 | A1 * | 6/2006 | Lopez de Cardenas et al. | 166/313 |

FOREIGN PATENT DOCUMENTS

| | | |
|---|---|---|
| CA | 2437678 | 2/2004 |

OTHER PUBLICATIONS www.packersplus.com Packers Plus Energy Services.
www.halliburton.com Technology * Expertise * Quality * Halliburton.
www.snydertex.com/mesquite/guiberson/htm Mesquite Oil Tools, Inc.: "Guiberson Retrievable Packers Systems, Uni-Packer V".
www.dresser.com.
Bellinger, C.E.; "Horizontal Well in the Devonian Shale, Martin County, Kentucky," Society of Petroleum Engineers, 1991, (SPE 23447).

* cited by examiner

*Primary Examiner* — Jennifer H Gay
*Assistant Examiner* — Brad Harcourt

(57) ABSTRACT

A cemented open hole selective fracing system and method are shown. In the producing zone, an open hole is drilled therein and a production tubing is cemented in place. At preselected locations along the production tubing, the production tubing will have sliding valves located there along. The sliding valves may be selectively opened, and the cement around the sliding valve dissolved. Thereafter, the formation may be fraced immediately adjacent the opened sliding valve. By selectively opening different combinations of sliding valves, fracing can occur in stages with more fracing pressure and more fracing fluid being delivered deeper into the formation. Just as the sliding valves can be selectively opened, the sliding valves can also be selectively closed to protect the production of the well.

49 Claims, 12 Drawing Sheets

CEMENTED OPEN HOLE SELECTIVE FRACING SYSTEM

CROSS-REFERENCE TO RELATED APPLICATIONS

This application claims the benefit of U.S. patent applications Ser. No. 11/079,950, filed Mar. 15, 2005 (now U.S. Pat. No. 7,267,172), and No. 11/359,059, filed Feb. 22, 2006 (now U.S. Pat. No. 7,377,322), which are incorporated herein by reference.

BACKGROUND OF THE INVENTION

1. Field of the Invention

This invention relates to a system for fracing producing formations for the production of oil or gas and, more particularly, for fracing in a cemented open hole using sliding valves, which sliding valves may be selectively opened or closed according to the preference of the producer.

2. Description of the Related Art

Fracing is a method to stimulate a subterranean formation to increase the production of fluids, such as oil or natural gas. In hydraulic fracing, a fracing fluid is injected through a well bore into the formation at a pressure and flow rate at least sufficient to overcome the pressure of the reservoir and extend fractures into the formation. The fracing fluid may be of any of a number of different media, including sand and water, bauxite, foam, liquid $CO_2$, nitrogen, etc. The fracing fluid keeps the formation from closing back upon itself when the pressure is released. The objective is for the fracing fluid to provide channels through which the formation fluids, such as oil and gas, can flow into the well bore and be produced.

One of the prior problems with earlier fracing methods is they require cementing of a casing in place and then perforating the casing at the producing zones. This in turn requires packers between various stages of the producing zone. An example of prior art that shows perforating the casing to gain access to the producing zone is shown in U.S. Pat. No. 6,446,727 to Zemlak, assigned to Schlumberger Technology Corporation. The perforating of the casing requires setting off an explosive charge in the producing zone. The explosion used to perforate the casing can many times cause damage to the formation. Plus, once the casing is perforated, then it becomes hard to isolate that particular zone and normally requires the use of packers both above and below the zone.

Another example of producing in the open hole by perforating the casing is shown in U.S. Pat. No. 5,894,888 to Wiemers. One of the problems with Wiemers is the fracing fluid is delivered over the entire production zone and you will not get concentrated pressures in preselected areas of the formation. Once the pipe is perforated, it is very hard to restore and selectively produce certain portions of the zone and not produce other portions of the zone.

When fracing with sand, sand can accumulate and block flow. United States Published Application 2004/0050551 to Jones shows fracing through perforated casing and the use of shunt tubes to give alternate flow paths. Jones does not provide a method for alternately producing different zones or stages of a formation.

One of the methods used in producing horizontal formations is to provide casing in the vertical hole almost to the horizontal zone being produced. At the bottom of the casing, either one or multiple holes extend horizontally. Also, at the bottom of the casing, a liner hanger is set with production tubing then extending into the open hole. Packers are placed between each stage of production in the open hole, with sliding valves along the production tubing opening or closing depending upon the stage being produced. An example is shown in U.S. Published Application 2003/0121663 A1 to Weng, wherein packers separate different zones to be produced with nozzles (referred to as "burst disks") being placed along the production tubing to inject fracing fluid into the formations. However, there are disadvantages to this particular method. The fracing fluid will be delivered the entire length of the production tubing between packers. This means there will not be a concentrated high pressure fluid being delivered to a small area of the formation. Also, the packers are expensive to run and set inside of the open hole in the formation.

Applicant previously worked for Packers Plus Energy Services, Inc., which had a system similar to that shown in Weng. By visiting the Packers Plus website of www.packersplus-.com, more information can be gained about Packers Plus and their products. Examples of the technology used by Packers Plus can be found in United States Published Application Nos. 2004/0129422, 2004/0118564, and 2003/0127227. Each of these published patent applications shows packers being used to separate different producing zones. However, the producing zones may be along long lengths of the production tubing, rather than in a concentrated area.

The founders of Packers Plus previously worked for Guiberson, which was acquired by Dresser Industries and later by Halliburton. The techniques used by Packers Plus were previously used by Guiberson/Dresser/Halliburton. Some examples of well completion methods by Halliburton can be found on the website of www.halliburton.com, including the various techniques they utilize. Also, the sister companies of Dresser Industries and Guiberson can be visited on the website of www.dresser.com. Examples of the Guiberson retrievable packer systems can be found on the Mesquite Oil Tool Inc. website of www.snydertex.com/mesquite/guiberson/htm.

None of the prior art known by applicant, including that of his prior employer, utilized cementing production tubing in place in the production zone with sliding valves being selectively located along the production tubing. None of the prior systems show (1) the sliding valve being selectively opened or closed, (2) the cement therearound being dissolved, and/or (3) selectively fracing with predetermined sliding valves. All of the prior systems known by applicant utilize packers between the various stages to be produced and have fracing fluid injected over a substantial distance of the production tubing in the formation, not at preselected points adjacent the sliding valves.

BRIEF SUMMARY OF THE INVENTION

It is an object of the present invention to provide a cemented open hole fracing system.

It is another object of the present invention to provide a cemented open hole fracing system that may be selectively operated by selecting and opening certain stages to be fraced, but not other stages.

It is still another object of the present invention to provide a system for fracing in the production zone with multiple stages of sliding valves, which sliding valves are cemented into place.

It is yet another object of the present invention to provide a cemented open hole fracing system that may be used in multi laterals with different valves being selectively operated so the production formation may be fraced in stages.

A well used to produce hydrocarbons is drilled into the production zone. Once in the production zone, either a single hole may extend there through, or there may be multiple holes in vertical or lateral configurations into the production zone connecting to a single wellhead. A casing is cemented into place below the wellhead. However, in the production zone, there will be an open hole. By use of a liner hanger at the end of the casing, production tubing is run into the open hole, which production tubing will have sliding valves located therein at preselected locations. The production tubing and sliding valves are cemented solid in the open hole. Thereafter, preselected sliding valves can be selectively opened and the cement therearound dissolved by a suitable acid or other solvent. Once the cement is dissolved, fracing may begin adjacent the preselected sliding valves. Any combination of sliding valves can be opened and dissolve the cement therearound. In this manner, more than one area can be fraced at a time. A fracing fluid is then injected through the production tubing and the preselected sliding valves into the production zone. The fracing fluid can be forced further into the formation by having a narrow annulus around the preselected sliding valves in which the fracing fluid is injected into the formation. This causes the fracing fluid to go deeper into the petroleum producing formation. By selective operation of the sliding valves with a shifting device, any number or combination of the sliding valves can be opened at one time. If it is desired to shut off a portion of the producing zone because it is producing water or is an undesirable zone, by operation of the sliding valve, that area can be shut off.

By the use of multi lateral connections, different laterals may be produced at different times or simultaneously. In each lateral, there would be a production pipe cemented into place with sliding valves at preselected locations there along. The producer would selectively connect to a particular lateral, either through a liner hanger mounted in the bottom of the casing, or through a window in the side of the casing. If a window is used in the side of the casing, it may be necessary to use a bent joint for connecting to the proper hanger. In the laterals, a packer may be used as a hanger in the open hole.

By the use of the present invention, many different laterals can be produced from a single well. The well operator will need to know the distance to the various laterals and the distance along the laterals to the various sliding valves. By knowing the distance, the operator can then (a) select the lateral and/or (b) select the particular valves to be operated for fracing. Shifting tools located on the end of a shifting string can be used to operate the sliding valves in whatever manner the well operator desires.

According to one aspect of the invention, a method of petroleum production from at least one open hole in at least one petroleum production zone of an oil and/or gas well is provided. The method comprises the steps of locating at least one selectively-openable sliding valve along a production tubing at a predetermined location, wherein at least one of the sliding valves is a ball-and-seat valve; inserting the at least one sliding valve and the production tubing into the open hole; cementing the sliding valves and the production tubing in place in the open hole; selectively opening the sliding valves and selectively dissolving the cement adjacent thereto with a solvent; selectively fracing through the sliding valves with fracing material; and selectively producing the petroleum production zone through the open hole of the well that has been (a) selectively opened (b) selectively dissolved, and (c) selectively fraced.

Another aspect of the present invention includes a cemented open hole selective fracing system for producing petroleum from an open hole in a production zone. The system comprises a production tubing disposed within the open hole and cemented in place therein and at least one selectively-openable sliding valve located along the production tubing and also cemented in place within the open hole. According to this aspect of the invention, at least one of the selectively-openable sliding valves is a ball-and-seat valve.

DETAILED DESCRIPTION OF THE INVENTION

Figure 1:
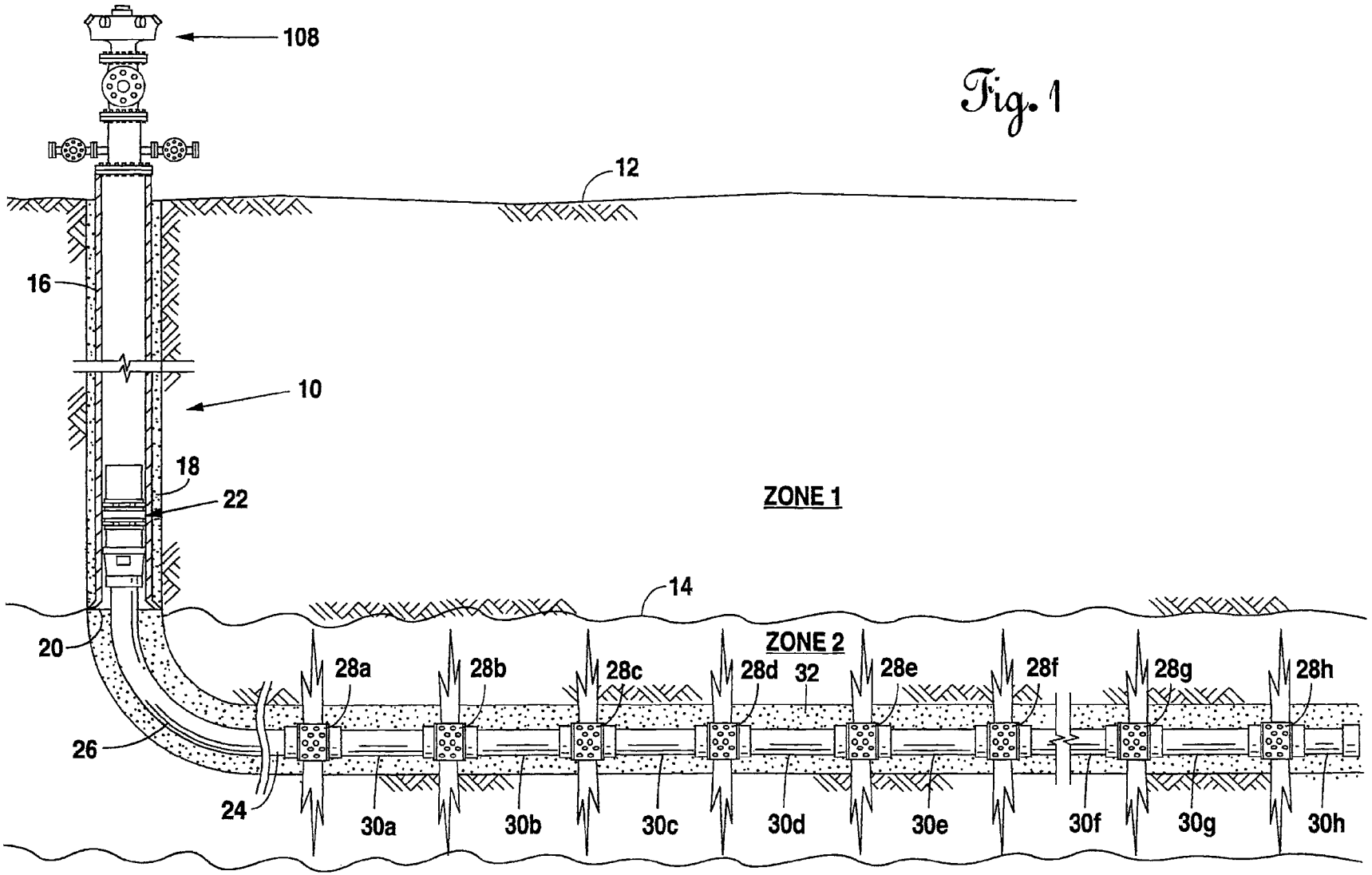
FIG. 1 is a partial sectional view of a well with a cemented open hole fracing system in a lateral located in a producing zone.

A cemented open hole selective fracing system is pictorially illustrated in FIG. 1. A production well 10 is drilled in the earth 12 to a hydrocarbon production zone 14. A casing 16 is held in place in the production well 10 by cement 18. At the lower end 20 of production casing 16 is located liner hanger 22. Liner hanger 22 may be either hydraulically or mechanically set.

Below liner hanger 22 extends production tubing 24. To extend laterally, the production well 10 and production tubing 24 bends around a radius 26. The radius 26 may vary from well to well and may be as small as thirty feet and as large as four hundred feet. The radius of the bend in production well 10 and production tubing 24 depends upon the formation and equipment used.

Inside of the hydrocarbon production zone 14, the production tubing 24 has a series of sliding valves pictorially illustrated as 28*a* thru 28*h*. The distance between the sliding valves 28*a* thru 28*h* may vary according to the preference of the particular operator. A normal distance is the length of a standard production tubing of 30 feet. However, the production tubing segments 30*a* thru 30*h* may vary in length depending upon where the sliding valves 28 should be located in the formation.

The entire production tubing 24, sliding valves 28*a*-28*h*, and the production tubing segments 30 are all encased in cement 32. Cement 32 located around production tubing 24 may be different from the cement 18 located around the casing 16.

In actual operation, sliding valves 28*a* thru 28*h* may be selectively opened or closed as will be subsequently described. The sliding valves 28*a* thru 28*h* may be opened in any order or sequence.

For the purpose of illustration, assume the operator of the production well 10 desires to open sliding valve 28*h*. A mechanical shifting tool 34, such as that shown in FIG. 2, connected on shifting string would be lowered into the production well 10 through casing 16 and production tubing 24. The shifting tool 34 has two elements 34*a*, 34*b* that are identical, except they are reversed in direction and connected by a shifting string segment 38. While the shifting string segment 38 is identical to shifting string 36, shifting string segment 38 provides the distance that is necessary to separate shifting tools 34*a*, 34*b*. Typically, the shifting string segment 38 would be about thirty feet in length.

Figure 3:
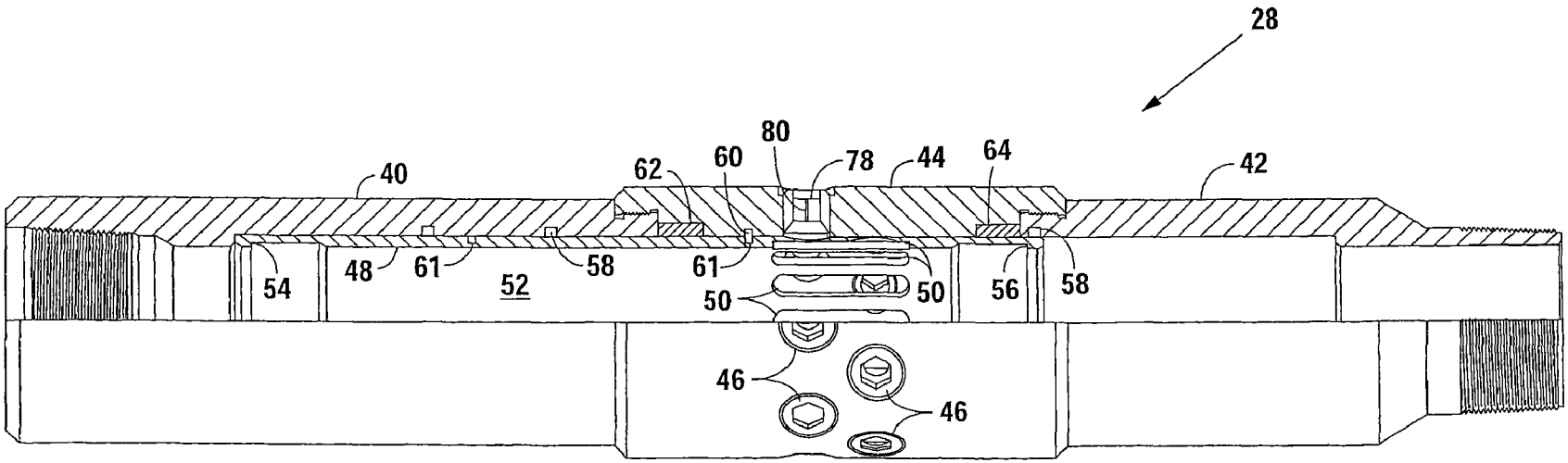
FIG. 3 is an elongated partial sectional view of a sliding valve.

To understand the operation of shifting tool 34 inside sliding valves 28*a*-28*h*, an explanation as to how the shifting tool 34 and sliding valves 28*a*-28*h* work internally is necessary. Referring to FIG. 3, a partial cross-sectional view of the sliding valve 28 is shown. An upper housing sub 40 is connected to a lower housing sub 42 by threaded connections via the nozzle body 44. A series of nozzles 46 extend through the nozzle body 44. Inside of the upper housing sub 40, lower housing sub 42, and nozzle body 44 is an inner sleeve 48. Inside of the inner sleeve 48 are slots 50 that allow fluid communication from the inside passage 52 through the slots 50 and nozzles 46 to the outside of the sliding valve 28. The inner sleeve 48 has an opening shoulder 54 and a closing shoulder 56 located therein.

Figure 4:
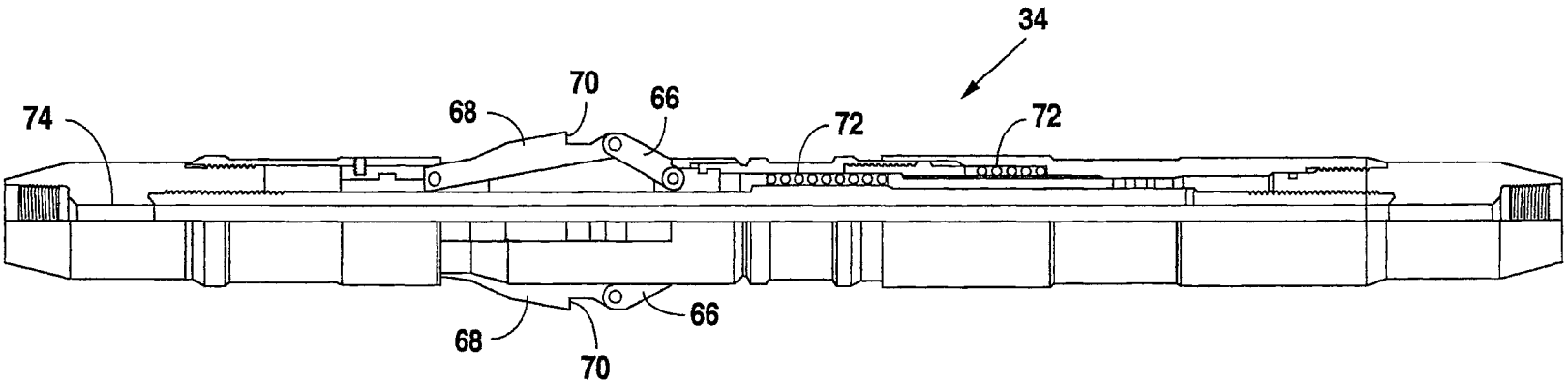
FIG. 4 is an elongated partial sectional view of a single mechanical shifting tool.

When the shifting tool 34 shown in FIG. 4 goes into the sliding valve 28, shifting tool 34*a* performs the closing function and shifting tool 34*b* performs the opening function. Shifting tools 34*a* and 34*b* are identical, except reverse and connected through the shifting string segment 38.

Figure 5A:
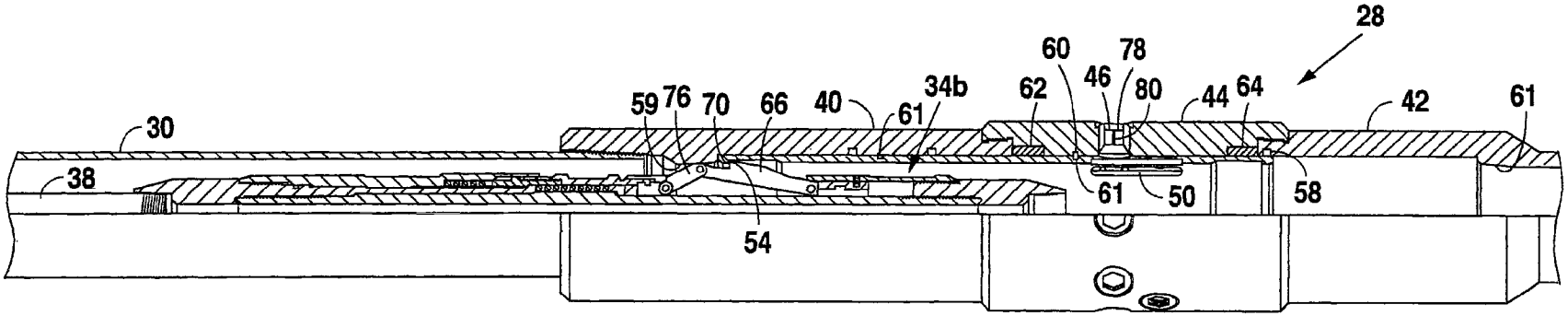
FIG. 5A is an elongated partial sectional view illustrating a mechanical shifting tool opening the sliding valve.

Assume the shifting tool 34 is lowered into production well 10 through the casing 16 and into the production tubing 24. Thereafter, the shifting tool 34 will go around the radius 26 through the shifting valves 28 and production pipe segments 30. Once the shifting tool 34*b* extends beyond the last sliding valve 28*h*, the shifting tool 34*b* may be pulled back in the opposite direction as illustrated in FIG. 5A to open the sliding valve 28, as will be explained in more detail subsequently.

Referring to FIG. 3, the sliding valve 28 has wiper seals 58 between the inner sleeve 48 and the upper housing sub 42 and the lower housing sub 44. The wiper seals 58 keep debris from getting back behind the inner sleeve 48, which could interfere with its operation. This is particularly important when sand is part of the fracing fluid.

Also located between the inner sleeve 48 and nozzle body 44 is a C-clamp 60 that fits in a notch undercut in the nozzle body 44 and into a C-clamp notch 61 in the outer surface of inner sleeve 48. The C-clamp puts pressure in the notches and prevents the inner sleeve 48 from being accidentally moved from the opened to closed position or vice versa, as the shifting tool is moving there through.

Also, seal stacks 62 and 64 are compressed between (1) the upper housing sub 40 and nozzle body 44 and (2) lower housing sub 42 and nozzle body 44, respectively. The seal stacks 62, 64 are compressed in place and prevent leakage from the inner passage 52 to the area outside sliding valve 28 when the sliding valve 28 is closed.

Turning now to the mechanical shifting tool 34, an enlarged partial cross-sectional view is shown in FIG. 4. Selective keys 66 extend outward from the shifting tool 34. Typically, a plurality of selective keys 66, such as four, would be contained in any shifting tool 34, though the number of selective keys 66 may vary. The selective keys 66 are spring loaded so they normally will extend outward from the shifting tool 34 as is illustrated in FIG. 4. The selective keys 66 have a beveled slope 68 on one side to push the selective keys 66 in, if moving in a first direction to engage the beveled slope 68, and a notch 70 to engage any shoulders, if moving in the opposite direction. Also, because the selective keys 66 are moved outward by spring 72, by applying proper pressure inside passage 74, the force of spring 72 can be overcome and the selective keys 66 may be retracted by fluid pressure applied from the surface.

Referring now to FIG. 5A, assume the opening shifting tool 34*b* has been lowered through sliding valve 28 and thereafter the direction reversed. Upon reversing the direction of the shifting tool 34*b*, the notch 70 in the shifting tool will engage the opening shoulder 54 of the inner sleeve 48 of sliding valve 28. This will cause the inner sleeve 48 to move from a closed position to an opened position as is illustrated in FIG. 5A. This allows fluid in the inside passage 58 to flow through slots 50 and nozzles 46 into the formation around sliding valve 28. As the inner sleeve 48 moves into the position as shown in FIG. 5A, C-clamp 60 will hold the inner sleeve 48 in position to prevent accidental shifting by engaging one of two C-clamp notches 61. Also, as the inner sleeve 48 reaches its open position and C-clamp 60 engages, simultaneously the inner diameter 59 of the upper housing sub 40 presses against the slope 76 of the selective key 66, thereby causing the selective keys 66 to move inward and notch 70 to disengage from the opening shoulder 54.

Figure 5B:
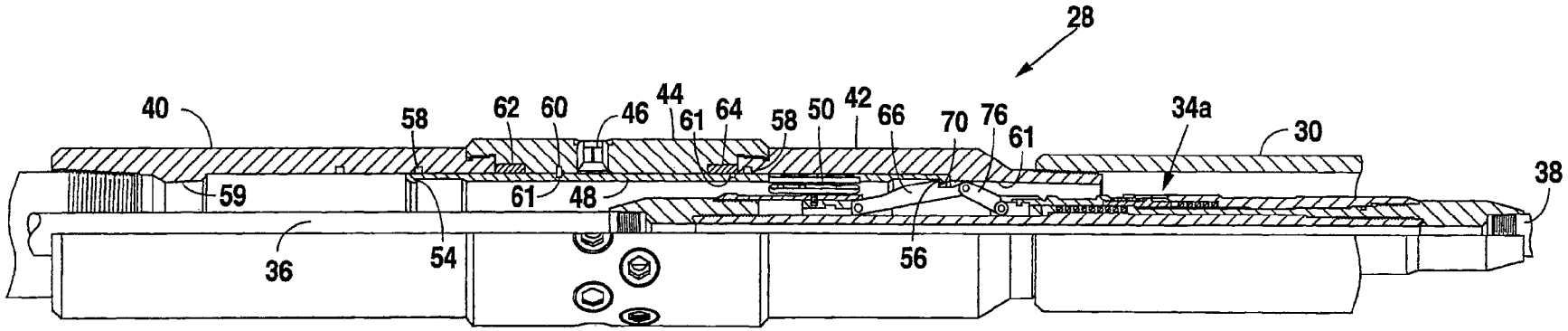
FIG. 5B is an elongated partial sectional view illustrating a mechanical shifting tool closing the sliding valve.

If it is desired to close a sliding valve 28, the same type of shifting tool will be used, but in the reverse direction, as illustrated in FIG. 5B. The shifting tool 34*a* is arranged in the opposite direction so that now the notch 70 in the selective keys 66 will engage closing shoulder 56 of the inner sleeve 48. Therefore, as the shifting tool 34*a* is lowered through the sliding valve 28, as shown in FIG. 5B, the inner sleeve 48 is moved to its lowermost position and flow between the slots 50 and nozzles 46 is terminated. The seal stacks 62 and 64 insure there is no leakage. Wiper seals 58 keep the crud from getting behind the inner sleeve 48.

Also, as the shifting tool 34*a* moves the inner sleeve 48 to its lowermost position, pressure is exerted on the slope 76 by the inner diameter 61 of lower housing sub 42 of the selective keys 66 to disengage the notch 70 from the closing shoulder 56. Simultaneously, the C-clamp 60 engages in another C-clamp notch 61 in the outer surface of the inner sleeve 48.

Figure 2:
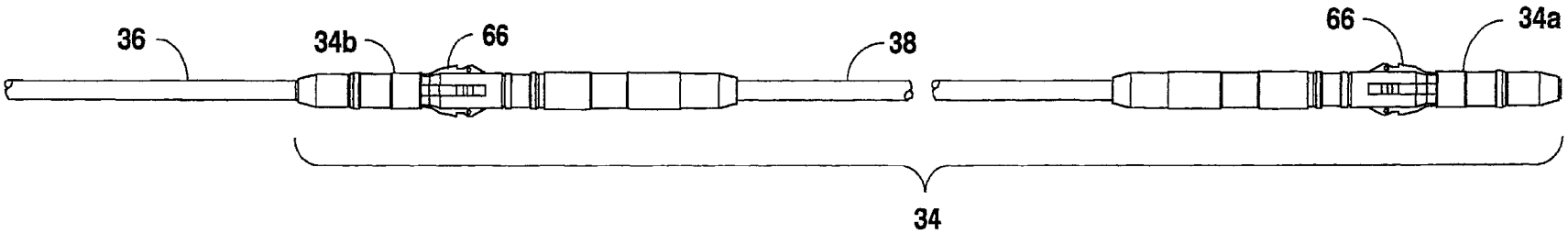
FIG. 2 is a longitudinal view of a mechanical shifting tool.

If the shifting tool 34, as shown in FIG. 2, was run into the production well 10 as shown in FIG. 1, the shifting tool 34 and shifting string 36 would go through the internal diameter of casing 16, internal opening of hanger liner 22, through the internal diameter of production tubing 24, as well as through sliding valves 28 and production pipe segments 30. Pressure could be applied to the internal passage 74 of shifting tool 34 through the shifting string 36 to overcome the pressure of springs 72 and to retract the selective keys 66 as the shifting tool 34 is being inserted. However, on the other hand, even without an internal pressure, the shifting tool 34*b*, due to the beveled slope 68, would not engage any of the sliding valves 28*a* thru 28*h* as it is being inserted. On the other hand, the shifting tool 34*a* would engage each of the sliding valves 28 and make sure the inner sleeve 48 is moved to the closed position. After the shifting tool 34*b* extends through sliding valve 28*h*, shifting tool 34*b* can be moved back towards the surface causing the sliding valve 28*h* to open. At that time, the operator of the well can send fracing fluid through the annulus between the production tubing 24 and the shifting string 36. Normally, an acid would be sent down first to dissolve the acid soluble cement 32 around sliding valve 28 (see FIG. 1). After dissolving the cement 32, the operator has the option to frac around sliding valve 28*h*, or the operator may elect to dissolve the cement around other sliding valves 28*a* thru 28*g*. Normally, after dissolving the cement 32 around sliding valve 28*h*, then shifting tool 34*a* would be inserted there through, which closes sliding valve 28*h*. At that point, the system would be pressure checked to insure sliding valve 28*h* was in fact closed. By maintaining the pressure, the selective keys 66 in the shifting tool 34 will remain retracted and the shifting tool 34 can be moved to shifting valve 28*g*. The process is now repeated for shifting valve 28*g*, so that shifting tool 34*b* will open sliding valve 28*g*. Thereafter, the cement 32 is dissolved, sliding valve 28*g* closed, and again the system pressure checked to insure valve 28*g* is closed. This process is repeated until each of the sliding valves 28*a* thru 28*h* has been opened, the cement dissolved, pressure checked after closing, and now the system is ready for fracing.

By determining the depth from the surface, the operator can tell exactly which sliding valve 28*a* thru 28*h* is being opened. By selecting the combination the operator wants to open, then fracing fluid can be pumped through casing 16, production tubing 24, sliding valves 28, and production tubing segments 30 into the formation.

By having a very limited area around the sliding valve 28 that is subject to fracing, the operator now gets fracing deeper into the formation with less fracing fluid. The increase in the depth of the fracing results in an increase in production of oil or gas. The cement 32 between the respective sliding valves 28*a* thru 28*h* confines the fracing fluids to the areas immediately adjacent to the sliding valves 28*a* thru 28*h* that are open.

Any particular combination of the sliding valves 28*a* thru 28*h* can be selected. The operator at the surface can tell when the shifting tool 34 goes through which sliding valves 28*a* thru 28*h* by the depth and increased force as the respective sliding valve is being opened or closed.

Applicant has just described one way of shifting the sliding sleeves used within the system of the present invention. Other types of shifting devices may be used including electrical, hydraulic, or other mechanical designs. While mechanical shifting using a shifting tool 34 is tried and proven, other designs may be useful depending on how the operator wants to produce the well. For example, the operator may not want to separately dissolve the cement 32 around each sliding valve 28*a*-28*h*, and pressure check, prior to fracing. The operator may want to open every third sliding valve 28, dissolve the cement, then frac. Depending upon the operator preference, some other type shifting device may be easily be used.

Another aspect of the invention is to prevent debris from getting inside sliding valves 28 when the sliding valves 28 are being cemented into place inside of the open hole. To prevent the debris from flowing inside the sliding valve 28, a plug 78 is located in nozzle 46. The plug 78 can be dissolved by the same acid that is used to dissolve the cement 32. For example, if a hydrochloric acid is used, by having a weep hole 80 through an aluminum plug 78, the aluminum plug 78 will quickly be eaten up by the hydrochloric acid. However, to prevent wear at the nozzles 46, the area around the aluminum plus 78 is normally made of titanium. The titanium resists wear from fracing fluids, such as sand.

While the use of plug 78 has been described, plugs 78 may not be necessary. If the sliding valves 28 are closed and the cement 32 does not stick to the inner sleeve 48, plugs 78 may be unnecessary. It all depends on whether the cement 32 will stick to the inner sleeve 48.

Further, the nozzle 46 may be hardened any of a number of ways instead of making the nozzles 46 out of titanium. The nozzles 46 may be (a) heat treated, (b) frac hardened, (c) made out of tungsten carbide, (d) made out of hardened stainless steel, or (e) made or treated any of a number of different ways to decrease and increase productive life.

Figure 6:
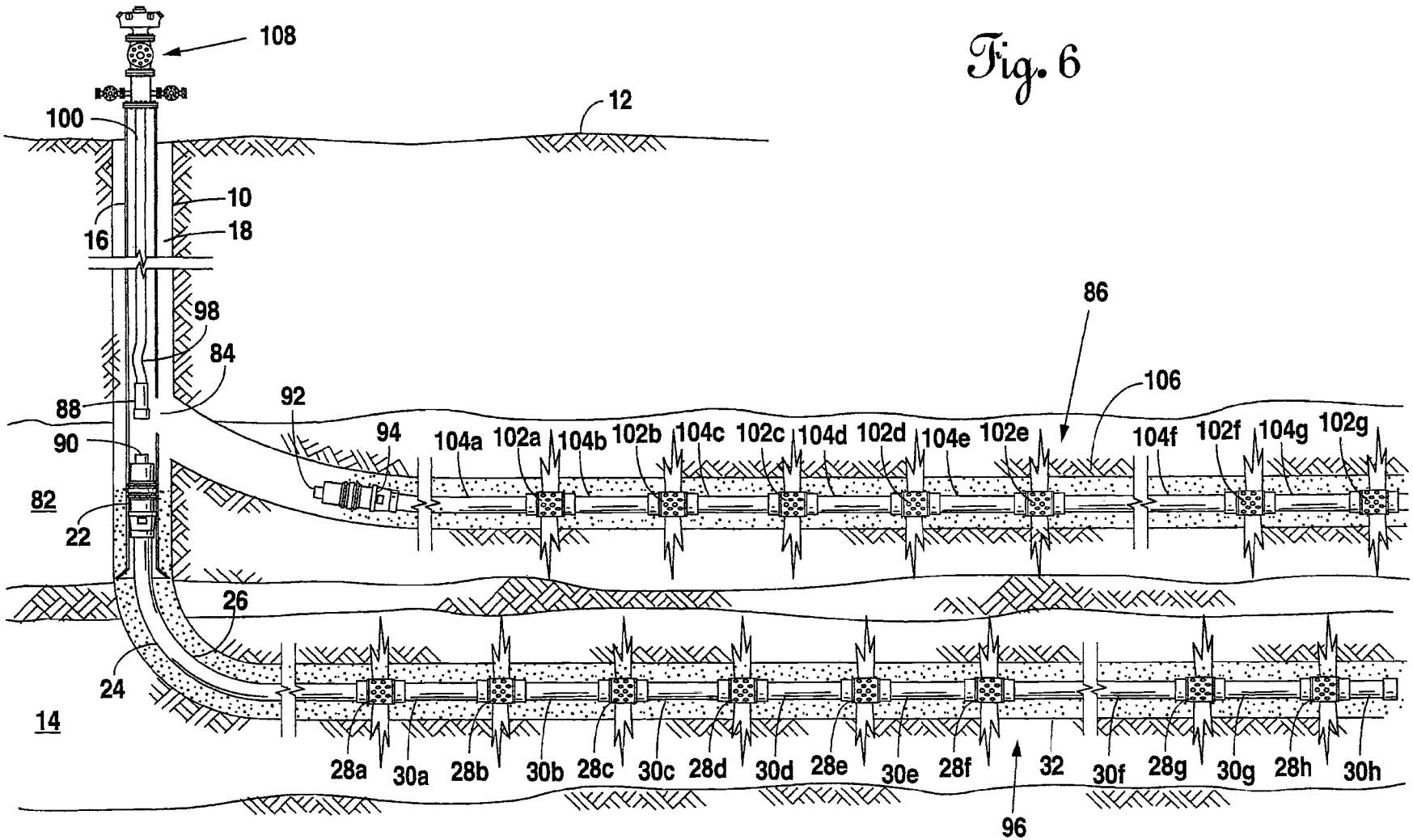
FIG. 6 is a pictorial sectional view of a cemented open hole fracing system having multiple laterals.

Assume the system as just described is used in a multilateral formation as shown in FIG. 6. Again, the production well 10 is drilled into the earth 12 and into a hydrocarbon production zone 14, but also into hydrocarbon production zone 82. Again, a liner hanger 22 holds the production tubing 24 that is bent around a radius 26 and connects to sliding valves 28*a* thru 28*h*, via production pipe segments 30*a* thru 30*h*. The production of zone 14, as illustrated in FIG. 6, is the same as the production as illustrated in FIG. 1. However, a window 84 has now been cut in casing 16 and cement 18 so that a horizontal lateral 86 may be drilled there through into hydrocarbon production zone 82.

In the drilling of wells with multiple laterals, or multilateral wells, an on/off tool 88 is used to connect to the stinger 90 on the liner hanger 22 or the stinger 92 on packer 94. Packer 94 can be either a hydraulic set or mechanical set packer to the wall 81 of the horizontal lateral 86. In determining which lateral 86, 96 to which the operator is going to connect, a bend 98 in the vertical production tubing 100 helps guide the on/off tool 88 to the proper lateral 86 or 96. The sliding valves 102*a* thru 102*g* may be identical to the sliding valves 28*a* thru 28*h*. The only difference is sliding valves 102*a* thru 102*g* are located in hydrocarbon production zone 82, which is drilled through the window 84 of the casing 16. Sliding valves 102*a* thru 102*g* and production tubing 104*a* thru 104*g* are cemented into place past the packer 94 in the same manner as previously described in conjunction with FIG. 1. Also, the sliding valves 102*a* thru 102*g* are opened in the same manner as sliding valves 28*a* thru 28*h* as described in conjunction with FIG. 1. Also, the cement 106 may be dissolved in the same manner.

Just as the multi laterals as described in FIG. 6 are shown in hydrocarbon production zones 14 and 82, there may be other laterals drilled in the same zones 14 and/or 82. There is no restriction on the number of laterals that can be drilled nor in the number of zones that can be drilled. Any particular sliding valve may be operated, the cement dissolved, and fracing begun. Any particular sliding valve the operator wants to open can be opened for fracing deep into the formation adjacent the sliding valve.

By use of the system as just described, more pressure can be created in a smaller zone for fracing than is possible with prior systems. Also, the size of the tubulars is not decreased the further down in the well the fluid flows. Although ball-operated valves may be used with alternative embodiments of the present invention, the decreasing size of tubulars is a particular problem for a series of ball operated valves, each successive ball-operated valve being smaller in diameter. This means the same fluid flow can be created in the last sliding valve at the end of the string as would be created in the first sliding valve along the string. Hence, the flow rates can be maintained for any of the selected sliding valves 28*a* thru 28*h* or 102*a* thru 102*g*. This results in the use of less fracing fluid, yet fracing deeper into the formation at a uniform pressure regardless of which sliding valve through which fracing may be occurring. Also, the operator has the option of fracing any combination or number of sliding valves at the same time or shutting off other sliding valves that may be producing undesirables, such as water.

Figure 7:
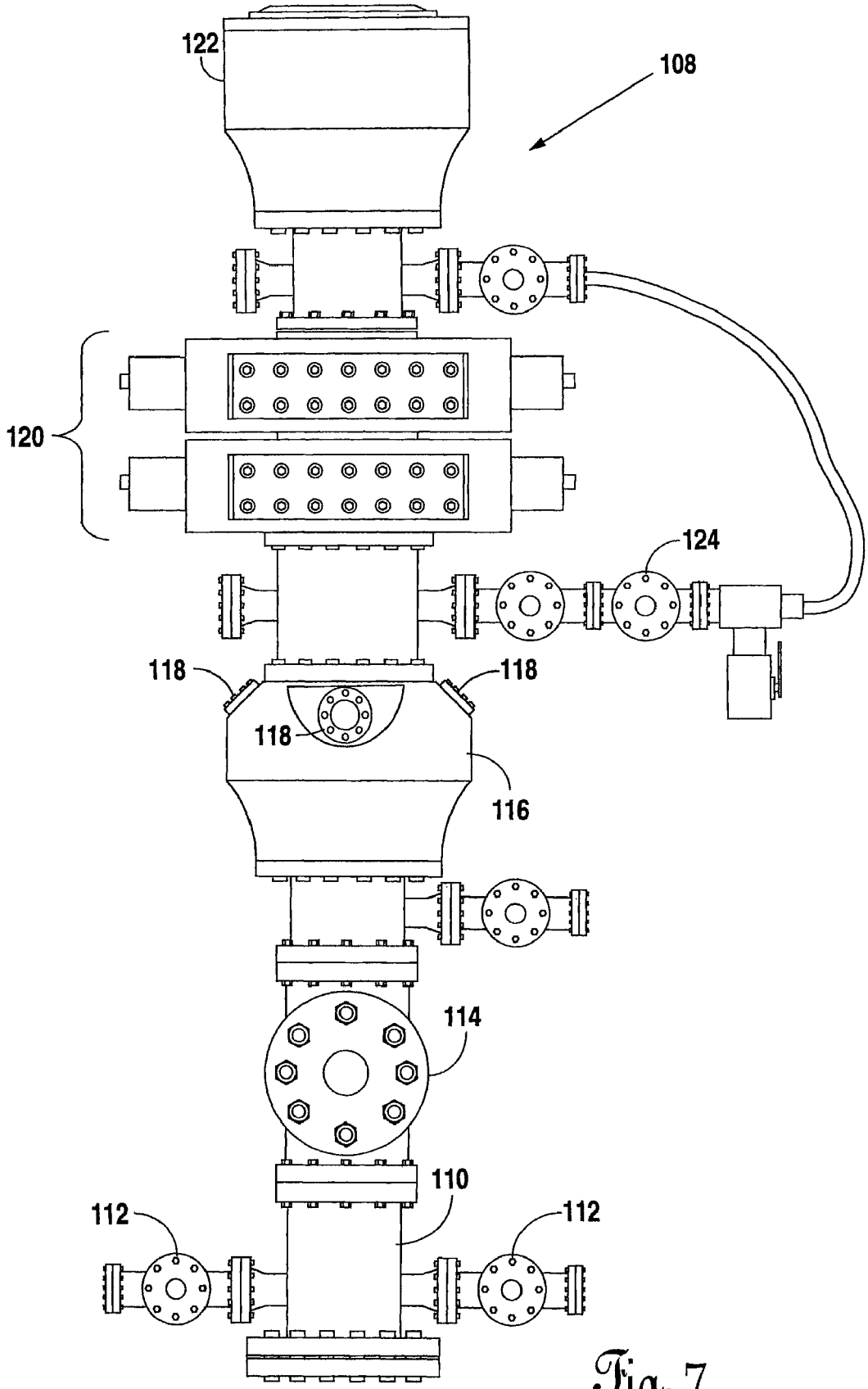
FIG. 7 is an elevated view of a wellhead.

On the top of casing 18 of production well 10 is located a wellhead 108. While many different types of wellheads are available, the wellhead preferred by applicant is illustrated in further detail in FIG. 7. A flange 110 is used to connect to the casing 16 that extends out of the production well 10. On the sides of the flange 110 are standard valves 112 that can be used to check the pressure in the well, or can be used to pump things into the well. A master valve 114 that is basically a float control valve provides a way to shut off the well in case of an emergency. Above the master valve 114 is a goat head 116. This particular goat head 116 has four points of entry 118, whereby fracing fluids, acidizing fluids or other fluids can be pumped into the well. Because sand is many times used as a fracing fluid and is very abrasive, the goat head 116 is modified so sand that is injected at an angle to not excessively wear the goat head. However, by adjusting the flow rate and/or size of the opening, a standard goat head may be used without undue wear.

Above the goat head 116 is located blowout preventer 120, which is standard in the industry. If the well starts to blow, the blowout preventer 120 drives two rams together and squeezes the pipe closed. Above the blowout preventer 120 is located the annular preventer 122. The annular preventer 122 is basically a big balloon squashed around the pipe to keep the pressure in the well bore from escaping to atmosphere. The annular preventer 122 allows access to the well so that pipe or tubing can be moved up and down there through. The equalizing valve 124 allows the pressure to be equalized above and below the blow out preventer 120. The equalizing of pressure is necessary to be able to move the pipe up and down for entry into the wellhead. All parts of the wellhead 108 are old, except the modification of the goat head 116 to provide injection of sand at an angle to prevent excessive wear. Even this modification is not necessary by controlling the flow rate.

Figure 8:
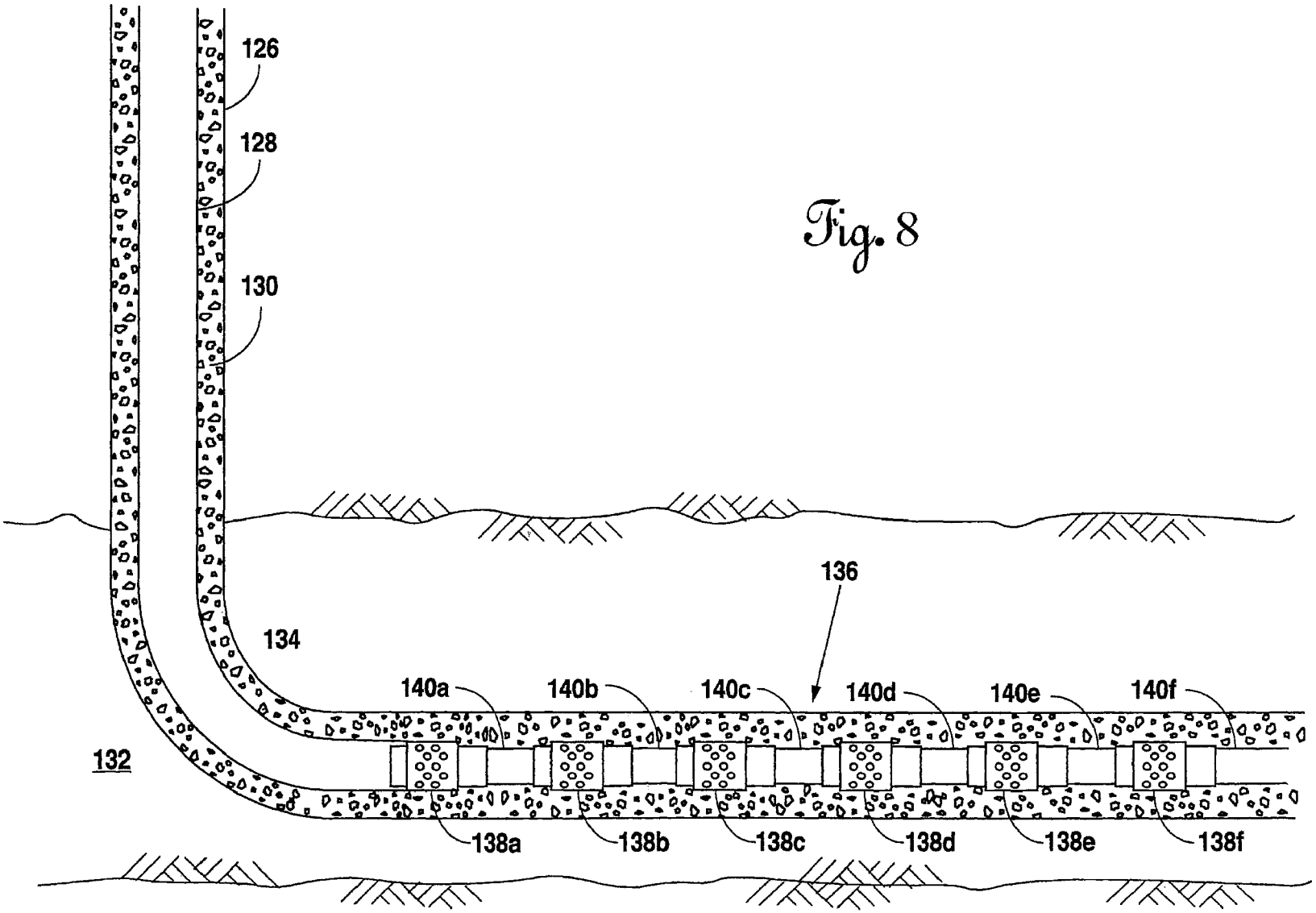
FIG. 8 is a cemented open hole horizontal fracing system.

Turning now to FIG. 8, the system as presently described has been installed in a well 126 without vertical casing. Well 126 has production tubing 128 held into place by cement 130. In the production zone 132, the production tubing 128 bends around radius 134 into a horizontal lateral 136 that follows the production zone 132. The production tubing 128 extends into production zone 132 around the radius 134 and connects to sliding valves 138*a* thru 138*f*, through production tubing segments 140*a* thru 140*f*. Again, the sliding valves 138*a* thru 138*f* may be operated so the cement 130 is dissolved therearound. Thereafter, any of a combination of sliding valves 138*a* thru 138*f* can be operated and the production zone 132 fraced around the opened sliding valve. In this type of system, it is not necessary to cement into place a casing nor is it necessary to use any type of packer or liner hanger. The minimum amount of hardware is permanently connected in well 126, yet fracing throughout the production zone 132 in any particular order as selected by the operator can be accomplished by simply fracing through the selected sliding valves 138*a* thru 138*f*.

Figure 9:
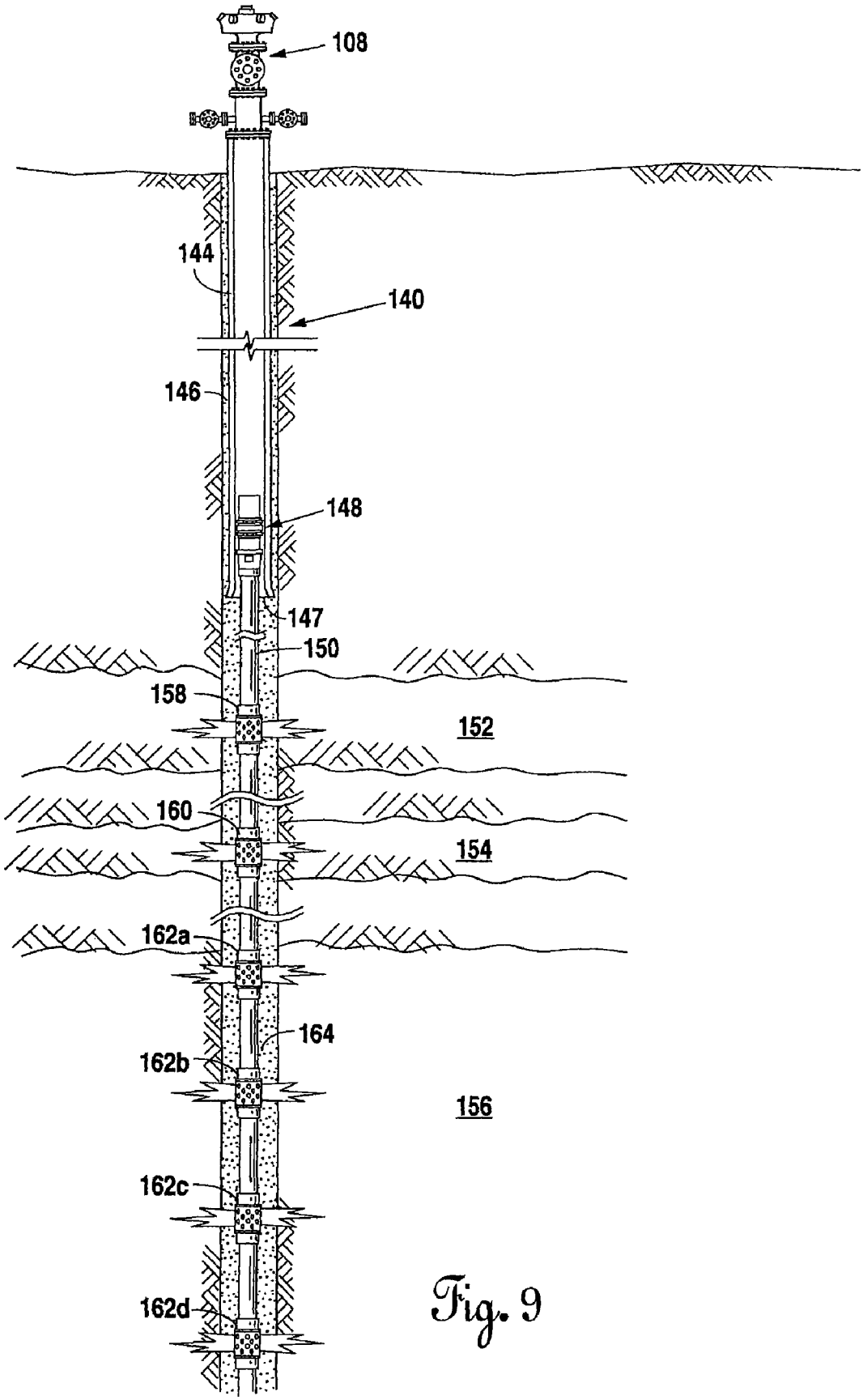
FIG. 9 is a cemented open hole vertical fracing system.

The system previously described can also be used for an entirely vertical well 140 as shown in FIG. 9. The wellhead 108 connects to casing 144 that is cemented into place by cement 146. At the bottom 147 of casing 144 is located a liner hanger 148. Below liner hanger 148 is production tubing 150. In the well 140, as shown in FIG. 9, there are producing zones 152, 154, and 156. After the production tubing 150 and sliding valves 158, 160, and 162*a* thru 162*d* are cemented into place by acid soluble cement 164, the operator may now produce all or selected zones. For example, by dissolving the cement 164 adjacent sliding valve 158, thereafter, production zone 152 can be fraced and produced through sliding valve 158. Likewise, the operator could dissolve the cement 164 around sliding valve 160 that is located in production zone 154. After dissolving the cement 164 around sliding valve 160, production zone 154 can be fraced and later produced.

On the other hand, if the operator wants to have multiple sliding valves 162*a* thru 162*d* operate in production zone 156, the operator can operate all or any combination of the sliding valves 162*a* thru 162*d*, dissolve the cement 164 therearound, and later frac through all or any combination of the sliding valves 162*a* thru 162*d*. By use of the method as just described, the operator can produce whichever zone 152, 154 or 156 the operator desires with any combination of selected sliding valves 158, 160 or 162.

Figure 10A:
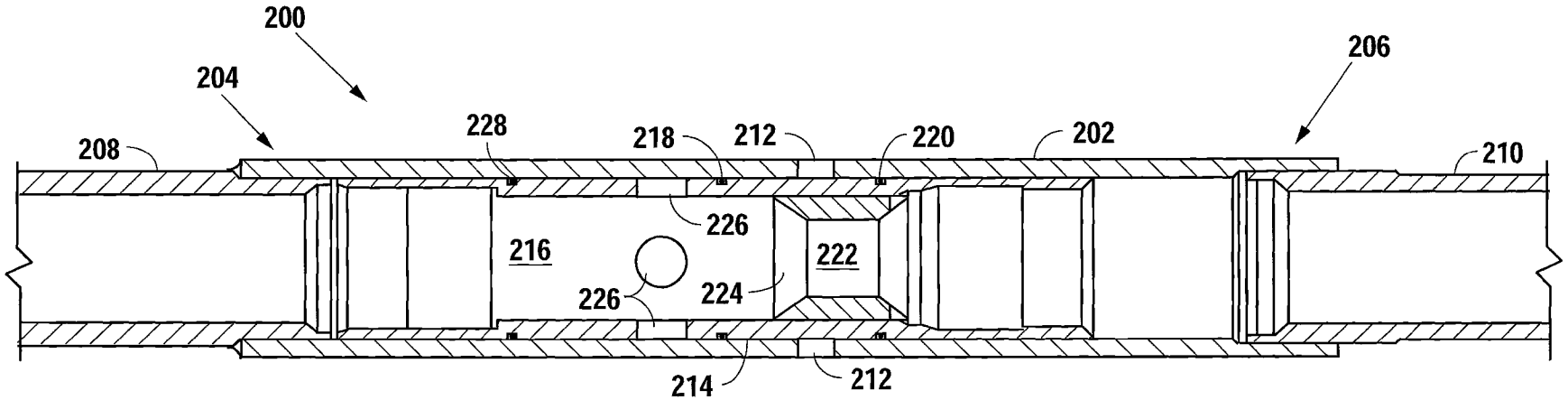
FIG. 10A is an elongated partial sectional view illustrating a ball-and-seat sliding valve in the "opened" position.
Figure 10B:
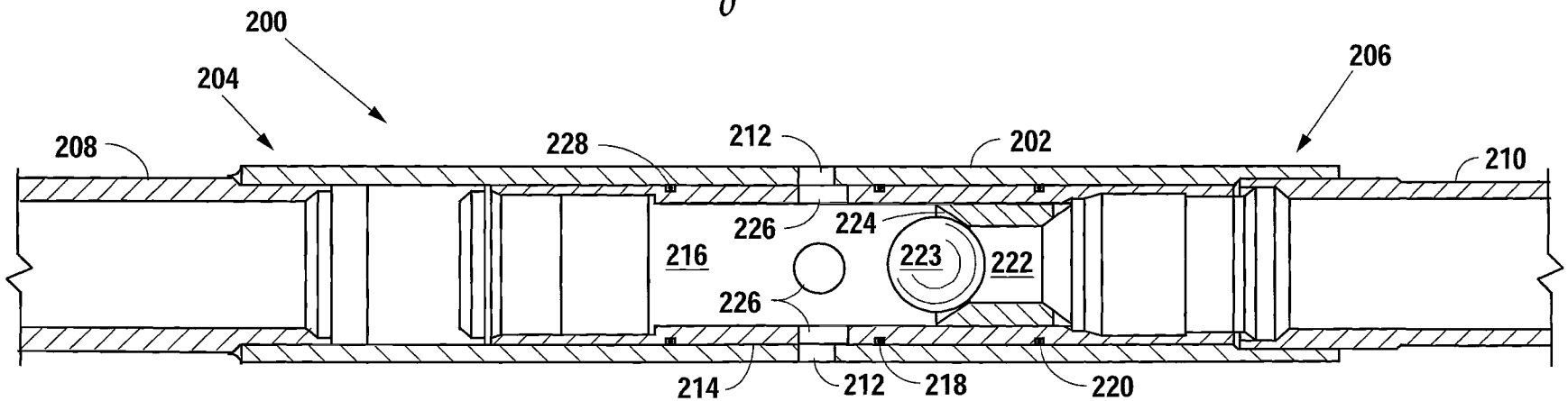
FIG. 10B is an elongated partial sectional view illustrating a ball-and seat sliding valve in the "closed" position.

Alternative embodiments of the present invention may include any number of sliding sleeve variants, such as a hydraulically actuated ball-and-seat valve 200 shown in FIGS. 10A and 10B. More specifically, FIG. 10A discloses a ball-and-seat valve 200 that has a mandrel 202 threadedly engaged at its upper end 204 with an upper sub 208 and at the lower end 206 with lower sub 210, respectively, attachable to production tubing segments (not shown). The mandrel 202 has a series of mandrel ports 212 providing a fluid communication path between the exterior of the ball-and-seat valve 200 to the interior of the mandrel 202.

FIG. 10A shows the ball-and-seat valve 200 in a "closed" position, wherein the fluid communication paths through the mandrel ports 212 are blocked by a lower portion 214 of the outer surface of an inner sleeve 216, which lower portion 214 is defined by a middle seal 218 and a lower seal 220, respectively. The middle seal 218 and lower seal 220 encircle the inner sleeve 216 to substantially prevent fluid from flowing between the outer surface of the inner sleeve 216 to the mandrel ports 212 in the mandrel 202.

The inner sleeve 216 is cylindrical with open ends to allow fluid communication through the interior thereof. The inner sleeve 216 further contains a cylindrical ball seat 222 opened at both ends and connected to the inner sleeve 216. When the ball-and-seat valve 200 is closed as shown in FIG. 10A, fluid may be communicated through the inner sleeve 216 and cylindrical ball seat 222 affixed thereto in either the upwell or downwell direction.

FIG. 10B shows the ball-and-seat valve 200 in an "open" position. When the ball-and-seat valve 200 is to be selectively opened, a ball 223 sealable to a seating surface 224 of the cylindrical ball seat 222 is pumped into the ball-and-seat valve 200 from the upper sub 208. The ball 223 is sized such that the cylindrical ball seat 222 impedes further movement of the ball 223 through the ball-and-seat valve 200 as the ball 223 contacts the seating surface 224 and seals the interior of the seat 222 from fluid communication therethrough. In other words, the sealing of the ball 223 to the ball seat 222 prevents fluid from flowing downwell past the ball-and-seat valve 200.

To open the ball-and-seat valve 200—in other words, to move the inner sleeve 216 to the "open" position—downward flow within the production tubing (not shown) is maintained. Because fluid cannot move through the seat 222 because the ball 223 is in sealing contact with the seating surface 224 thereof, pressure upwell from the ball 223 may be increased to force the ball 223, and therefore the inner sleeve 216, downwell until further movement of the inner sleeve 216 is impeded by contacting the lower sub 210.

As shown in FIG. 10B, when the inner sleeve 216 is in the "open" positioned, a series of sleeve ports 226 provide a fluid communication path between the exterior and interior of the inner sleeve 216 and are aligned with the mandrel ports 212 to permit fluid communication therethrough from and to the interior of the ball-and-seat valve 200, and more specifically to the interior of the inner sleeve 216. When the ball-and-seat valve 200 is "open," fluid communication to and from the interior of the ball-and-seat valve 200 other than through the mandrel ports 212 and sleeve ports 226 is prevented by an upper seal 228 and the middle seal 218 encircling the outer surface of the inner sleeve 216. The ball-and-seat valve 200 may thereafter be closed through the use of conventional means, such as a mechanical shifting tool lowered through the production tubing, as described with reference to the preferred embodiment.

When multiple ball-and-seat valves are used in a production well, each of the ball-and-seat valves will have a ball seat sized differently from the ball seats of the other valves used in the same production tubing. Moreover, the valve with the largest diameter ball seat will be located furthest upwell, and the valve with the smallest diameter ball seat will be located furthest downwell. Because the size of the seating surface of each ball seat is designed to mate and seal to a particularly-sized ball, valves are chosen and positioned within the production string so that balls will flow through any larger-sized, upwell ball seats until the appropriately-sized seat is reached. When the appropriately-sized ball seat is reached, the ball will mate and seal to the seat, blocking any upwell-to-downwell fluid flow as described hereinabove. Thus, when selectively opening multiple ball-and-seat valves within a production string, the valve furthest downwell is typically first opened, then the next furthest, and so on.

Figure 11A:
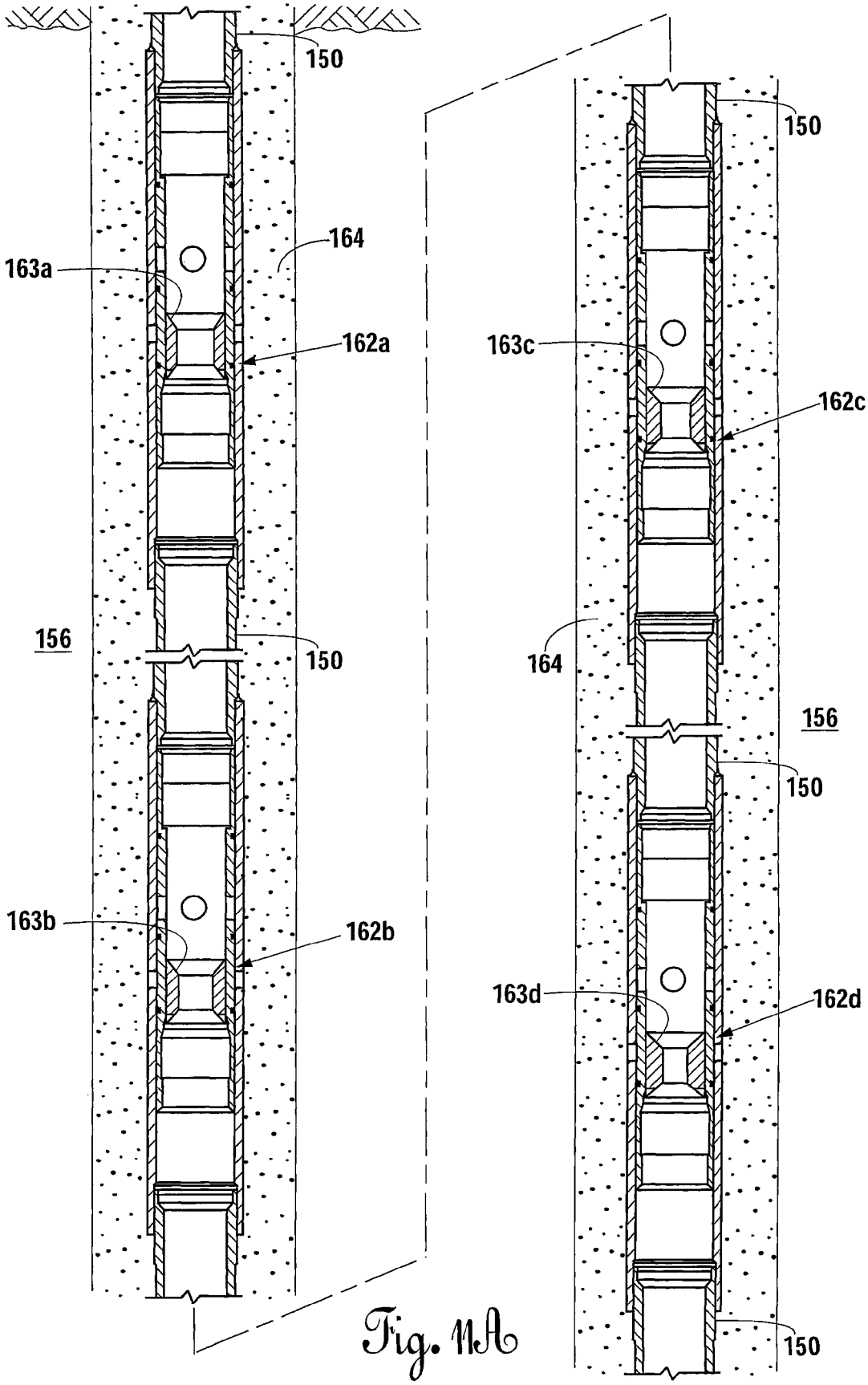
FIGS. 11A-11C are enlarged sectional views of the valves of the cemented open hole vertical fracing system shown in FIG. 9 that disclose in more detail how the ball-and-seat sliding valves are selectively opened and closed.
Figure 11B:
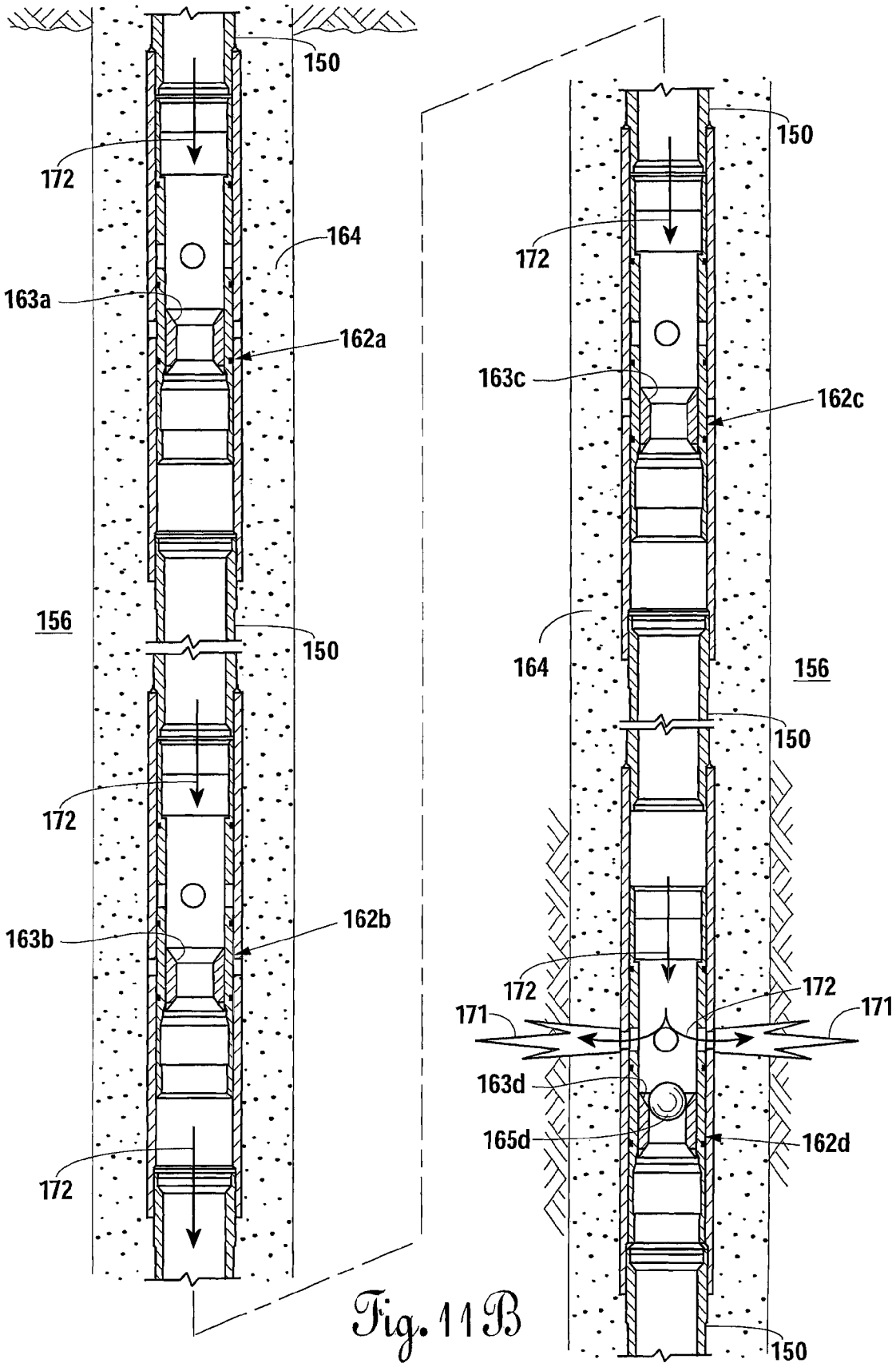
Figure 11C:
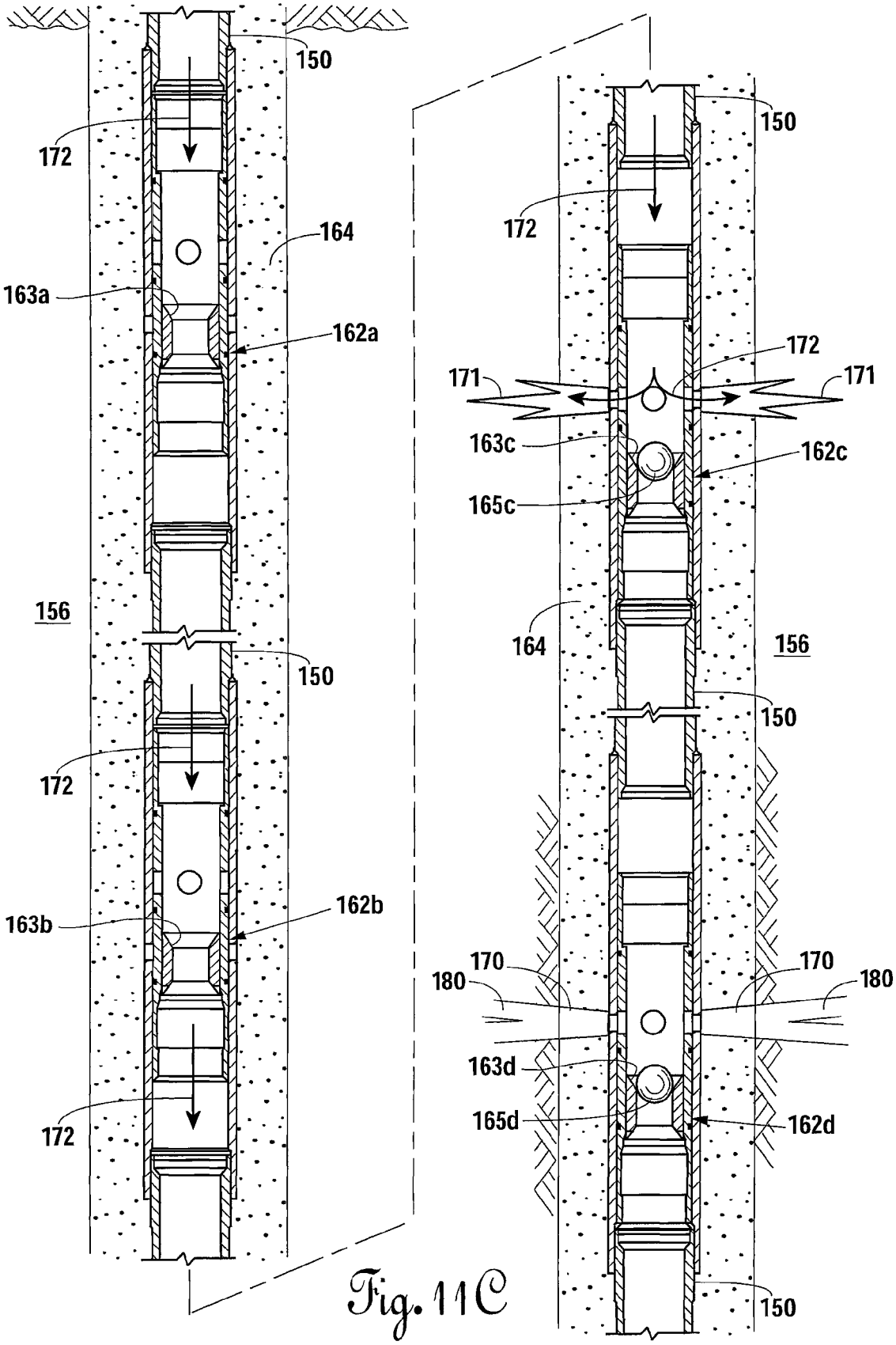

Referring to FIGS. 11A-11C in sequence, and by way of example, assume that the production well shown in FIG. 9 uses four ball-and-seat valves 162*a*-162*d* in the production zone 156. As shown in FIG. 11A, further assume that the ball-and-seat valves 162*a*-162*d* are sized as follows: The deepest ball-and-seat valve 162*d* has a ball seat 163*d* with an inner diameter of 1.36" and matable to a ball (not shown) having a 1.50" diameter; the next deepest ball-and-seat valve 162*c* has a ball seat 163*c* with an inner diameter of 1.86" and matable to a ball (not shown) having a 2.00" diameter; the next deepest valve 162*b* has a ball seat 163*b* with an inner diameter of 2.36" and matable to a ball (not shown) having a 2.50" diameter; and the shallowest ball-and-seat valve 162*a* has a ball seat 163*a* with an inner diameter of 2.86" and matable to a ball (not shown) having a 3.00" diameter. The ball-and-seat valves 162*a*-162*d* are connected with segments of production tubing 150. The ball-and-seat valves 162*a*-162*d* and production tubing 150 are cemented into place in an open hole with cement 164.

As shown in FIG. 11B, to open the deepest valve 162*d*, a ball 165*d* having a 1.50" diameter is pumped through the production tubing 150 and shallower ball-and-seat valves 162*a*-162*c*. Because the 1.50" diameter of the ball 165*d* is smaller than the inner diameters of each of the ball seats 163*a*-163*c* of the other valves 162*a*-162*c*—which are 2.86", 2.36", and 1.86–, respectively—the ball 165*d* will flow in a downwell direction 172 through each of the shallower ball-and-seat valves 162*a*-162*c* until further downwell movement is impeded by the smaller 1.36" diameter ball seat 163*d* of the deepest ball-and-seat valve 162*d*. At that point, if the ball-and-seat valve 162*d* is in the closed position (see FIG. 10A), fluid pressure within the production tubing 150 may be increased to selectively open the ball-and-seat valve 162*d* as previously described with reference to FIG. 10B hereinabove. After selectively opening the deepest ball-and-seat valve 162*d*, the cement 164 adjacent thereto may be dissolved with a solvent 171 and the production zone 156 can be fraced and produced through ball-and-seat valve 162*d*, as previously described. As shown in FIG. 11C, dissolving the cement 164 adjacent thereto leaves passages 170 through which fracing material may be forced into cracks 180 in the production zone 156 and through which oil from the surrounding production zone 156 may be produced.

Further referring to FIG. 11C, to open the next deepest ball-and-seat valve 162*c*, a ball 165*c* having a 2.00" diameter is pumped through the production tubing 150 and two shallower ball-and-seat valves 162*a*, 162*b*. Because the 2.00" diameter of the ball 165*c* is smaller than the inner diameters of the two shallower ball-and-seat valves 162*a*, 162*b* which are 2.86" and 2.36", respectively—the ball 165*c* will flow in a downwell direction 172 through each of the ball-and-seat valves 162*a*, 162*b* until further downwell movement is impeded by the smaller 1.86" diameter ball seat 163*c* of the second deepest valve 162*c*. If the ball-and-seat valve 162*c* is closed, fluid pressure within the production tubing 150 may be increased to selectively open the ball-and-seat valve 162*c* as previously described with reference to FIG. 10B hereinabove. After selectively opening the ball-and-seat valve 162*c*, the cement 164 adjacent thereto may be dissolved and the production zone 156 can be fraced and produced through ball-and-seat valve 162*c*. This process may be repeated until all desired valves within the production well have been selectively opened and fraced and/or produced.

After having been pumped into the production well to selectively trigger corresponding ball-and-seat sliding valves, the balls may be pumped from the production well during production by reversing the direction of flow. Alternatively, seated balls may be milled, and thus fractured such that the pieces of the balls return to the well surface and may be retrieved therefrom.

By use of the method as described, the operator, by cementing the sliding valves into the open hole and thereafter dissolving the cement, can frac just in the area adjacent to the sliding valve. By having a limited area of fracing, more pressure can be built up into the formation with less fracing fluid, thereby causing deeper fracing into the formation. Such deeper fracing will increase the production from the formation. Also, the fracing fluid is not wasted by distributing fracing fluid over a long area of the well, which results in less pressure forcing the fracing fluid deep into the formation. In fracing over long areas of the well, there is less desirable fracing than what would be the case with the present invention.

The present invention shows a method of fracing in the open hole through cemented in place sliding valves that can be selectively opened or closed depending upon where the production is to occur. Preliminary experiments have shown that the present system described hereinabove produces better fracing and better production at lower cost than prior methods.

The present invention is described above in terms of a preferred illustrative embodiment of a specifically described cemented open-hole selective fracing system and method, as well as an alternative embodiment of the present invention. Those skilled in the art will recognize that other alternative embodiments of such a system and method can be used in carrying out the present invention. Other aspects, features, and advantages of the present invention may be obtained from a study of this disclosure and the drawings, along with the appended claims.

I claim:

1. A method of petroleum-production from at least one open hole in at least one petroleum production zone of an oil and/or gas well comprising the steps of:

locating a plurality of selectively-openable sliding valves spaced apart along a production tubing at predetermined locations, wherein at least one of said plurality of selectively-openable sliding valves is a ball-and-seat valve;

inserting said plurality of selectively-openable sliding valves and said production tubing into said at least one open hole;

cementing said plurality of selectively-openable sliding valves and said production tubing permanently in place in said at least one open hole, said predetermined locations along said production tubing being in said petroleum production zone in said at least one open hole;

selectively opening said at least one of said plurality of said selectively-openable sliding valves;

selectively removing some of said cement adjacent said plurality of selectively openable sliding valves without using jetting or cutting tools to establish access therefrom to said at least one petroleum production zone;

selectively fracing through said selectively opened of said plurality of said selectively-openable sliding valve with fracing material; and selectively producing said at least one petroleum production zone through said plurality of said selectively-openable valves in said open hole of said oil and/or gas well that has been (a) selectively opened and (b) selectively removed and/or fraced.

2. The method of petroleum production as recited in claim 1 wherein said plurality of selectively-openable sliding valves comprises a plurality of ball-and-seat valves, each of said plurality of ball-and-seat valves having a ball seat matable to a ball that is not matable to any other of said plurality of ball-and-seat valves.

3. The method of petroleum production as recited in claim 2 wherein said locating step comprises arranging said plurality of ball-and-seat valves along said production tubing at predetermined locations such that said ball-and-seat valve having the smallest size ball seat is positioned downwell from said ball-and-seat valve having the largest size ball seat.

4. The method of petroleum production as recited in claim 3 wherein said locating step further comprises arranging all other of said ball-and-seat valves along said production tubing at predetermined locations in decreasing order of the size of said ball seats and between said ball-and-seat valve having the largest size ball seat and said ball-and-seat valve having the smallest size ball seat.

5. The method of petroleum production as recited in claim 4 wherein said selectively opening step further comprises pumping a ball matable through said production tubing to the ball seat of said selectively-openable ball-and-seat valves to be selectively opened.

6. The method of petroleum production as recited in claim 5 wherein said selectively opening step further comprises opening said ball-and-seat valves in increasing order of the size of said ball seats.

7. The method of petroleum production as recited in claim 1 including a first step of cementing a casing from a top of said oil and/or gas well downward toward said at least one open hole.

8. The method of petroleum production as recited in claim 7 including securing a well head at a top of said casing.

9. The method of petroleum production as recited in claim 8 wherein said at least one open hole is a lateral.

10. The method of petroleum production as recited in claim 8 wherein said at least one open hole consists of a plurality of lateral open holes, each of said lateral open holes having all of the steps of claim 1 performed thereof.

11. The method of petroleum production as recited in claim 10 wherein a first one of said plurality of lateral open holes may be selected by an on/off tool connecting to a first stinger on an outer end of said production tubing in said first one of said plurality of lateral open holes.

12. The method of petroleum production as recited in claim 11 wherein a second one of said plurality of lateral open holes may be selected by an on/off tool (a) disconnecting from said first stinger on said outer end of said production tubing in said first one of said lateral open holes and (b) connecting to a second stinger on an outer end of said production tubing in said second one of said plurality of lateral open holes, the steps of claim 1 being repeated.

13. The method of petroleum production as recited in claim 12 wherein the steps of claim 12 and claim 1 are repeated for each of said lateral open holes.

14. The method of petroleum production as recited in claim 8 wherein said oil and/or gas well has a plurality of petroleum production zones, said steps given in claim 1 being repeated for each of said plurality of petroleum production zones.

15. The method of petroleum production as recited in claim 1 wherein flow rate and/or fracing pressures can be maintained by opening or closing different ones of said sliding valves.

16. The method of petroleum production as recited in claim 1 wherein an undesirable production can be reduced by closing different ones of said sliding valves.

17. The method of petroleum production as recited in claim 1 wherein said selectively removing and/or fracing is with said fracing material.

18. The method of petroleum production from said at least one open hole in said at least one production zone of said oil and/or gas well as recited in claim 1 wherein said selective opening of said at least one ball-and-seat valve is hydraulically actuated.

19. The method of petroleum production from said at least one open hole in said at least one production zone of said oil and/or gas well as recited in claim 18 wherein said selective opening of other sliding valves is mechanically actuated using a shifting tool.

20. A cemented open hole selective fracing system for producing petroleum from at least one open hole in at least one petroleum production zone of an oil and/or gas well comprising:

production tubing inserted into said open hole;

a plurality of ball-and-seat valves spaced along said production tubing at predetermined locations in said at least one petroleum production zone of said oil and/or gas well, wherein each of said plurality of ball-and-seat valves has a differently-sized ball seat;

cement holding said production tubing and said plurality of selectively openable sliding valves permanently in place in said at least one open hole;

a plurality of differently-sized balls, each of said plurality of differently-sized balls being matable to only one of said differently-sized ball seats to selectively open said plurality of ball-and-seat valves;

a fluid comprising a solvent, said fluid selectively flowing through said ball-and-seat valves to remove cement adjacent thereto without jetting or cutting tools;

a fracing material selectively flowing through said ball-and-seat valves to frac into said production zone;

wherein said removing and fracing is repeatable as each of said plurality of ball-and-seat valves is selectively opened.

21. The cemented open hole selective fracing system of claim 20 wherein said fluid and said fracing material are the same.

22. The cemented open hole selective fracing system of claim 20 wherein said plurality of ball-and-seat valves are located along said production tubing at said predetermined locations such that said ball-and-seat valve having the smallest ball seat is positioned downwell from said ball-and-seat valve having the largest ball seat.

23. The cemented open hole selective fracing system of claim 22 wherein all other ball-and-seat valves are arranged along said production tubing at predetermined locations in order of the size of said ball seats and between said ball-and-seat valve having the smallest ball seat and said ball-and-seat valve having the largest ball seat.

24. The cemented open hole selective fracing system of claim 23 wherein said plurality of ball-and-seat valves is openable in an order corresponding to the increasing size of said ball seats.

25. The cemented open hole selective fracing system of claim 20 wherein cement adjacent to at least one of said plurality of selectively-openable sliding valve has been removed with said fluid.

26. The cemented open hole selective fracing system of claim 20 further comprising a casing cemented from a top of said oil and/or gas well and extending downward toward said at least one open hole.

27. The cemented open hole selective fracing system of claim 26 further comprising a well head secured to a top of said casing.

28. The cemented open hole selective fracing system of claim 20 further wherein said at least one open hole is a lateral.

29. The cemented open hole selective fracing system of claim 28 wherein said at least one open hole consists of a plurality of lateral open holes and the system further comprises:

a plurality of production tubings, a production tubing being disposed within each of said plurality of open holes and cemented in place therein; and at least one ball-and-seat valve located along each of said production tubings at a predetermined location and cemented permanently in place within one of said plurality of lateral open holes.

30. The cemented open hole selective fracing system of claim 29 further comprising a stinger on an outer end of each of said production tubings.

31. A method of producing petroleum from at least one open hole in at least one petroleum production zone of an oil and/or gas well comprising:

locating a plurality of sliding valves spaced apart along a production tubing at predetermined locations;

inserting said plurality of said sliding valves and said production tubing into said at least one open hole;

cementing said plurality of said sliding valves and said production tubing permanently in place in said at least one open hole with cement, said predetermined locations along said production tubing corresponding to predetermined locations in said at least one open hole;

selectively opening said plurality of sliding valves;

selectively removing some of said cement adjacent to said plurality of sliding valves without using jetting or cutting tools to establish contact with said at least one petroleum production zone;

selectively fracing through said plurality of sliding valves with fracing material; and selectively producing said at least one petroleum production zone through said at least one open hole of said oil and/or gas well that has been (a) selectively opened and (b) selectively removed and/or fraced.

32. The method of petroleum production from said at least one open hole in said at least one production zone of said oil and/or gas well as recited in claim 31 including a first step of cementing a casing from a top of said oil and/or gas well downward toward said at least one open hole.

33. The method of petroleum production from said at least one open hole in said at least one production zone of said oil and/or gas well as recited in claim 32 including securing a well head at a top of said casing.

34. The method of petroleum production from said at least one open hole in said at least one production zone of said oil and/or gas well as recited in claim 31 wherein said at least one open hole is a lateral.

35. The method of petroleum production from said at least one open hole in said at least one production zone of said oil and/or gas well as recited in claim 31 wherein said at least one open hole consists of a plurality of lateral open holes, each of said lateral open holes having all of the steps of claim 31 performed thereof.

36. The method of petroleum production from said at least one open hole in said at least one production zone of said oil and/or gas well as recited in claim 35 wherein a first one of said lateral open holes may be selected by an on/off tool connecting to a first stinger on an outer end of said production tubing in said first one of said lateral open holes.

37. The method of petroleum production from said at least one open hole in said at least one production zone of said oil and/or gas well as recited in claim 36 wherein a second one of said lateral open holes may be selected by an on/off tool (a) disconnecting from said first stinger on said outer end of said production tubing in said first one of said lateral open holes and (b) connecting to a second stinger on an outer end of said producing tubing in said second one of said lateral open holes, the steps of claim 31 being repeated.

38. The method of petroleum production from said at least one open hole in said at least one production zone of said oil and/or gas well as recited in claim 37 wherein the steps of claim of 37 and 31 are repeated for each of said lateral open holes.

39. The method of petroleum production from said at least one open hole in said at least one production zone of said oil and/or gas well as recited in claim 31 wherein said oil and/or gas well has a plurality of petroleum production zones, said steps given in claim 31 being repeated for each plurality of petroleum production zones.

40. The method of petroleum production from said at least one open hole in said at least one production zone of said oil and/or gas well as recited in claim 31 wherein flow rate and/or fracing pressures can be maintained by opening or closing different ones of said sliding valves.

41. The method of petroleum production from said at least one open hole in said at least one production zone of said oil and/or gas well as recited in claim 31 wherein an undesirable production can be reduced by closing different ones of said sliding valves.

42. An open hole selective fracing system for producing petroleum from at least one open hole in at least one petroleum production zone of an oil and/or gas well comprising:

production tubing inserted into said open hole;

a plurality of selectively openable sliding valves spaced along said production tubing at predetermined locations in said at least one petroleum production zone of said oil and/or gas well;

cement holding said production tubing and said plurality of selectively openable sliding valves permanently in place in said at least one open hole;

a fluid comprising a solvent, said fluid selectively flowing through said sliding valves to remove cement adjacent thereto without jetting or cutting tools;

a fracing material selectively flowing through said sliding valves to frac into said production zone;

wherein said removing and fracing is repeatable as each of said plurality of sliding valves is selectively opened.

43. The selective fracing system of claim 42 wherein each of said at least one selectively-openable sliding valve is at least one of mechanically actuatable, hydraulically actuatable, and electrically actuatable.

44. The selective fracing system of claim 42 further comprising a casing cemented from a top of said oil and/or gas well and extending downward toward said at least one open hole.

45. The selective fracing system of claim 42 wherein said fluid and said facing material are the same.

46. The selective fracing system of claim 45 wherein said at least one open hole consists of a plurality of lateral open holes and the system further comprises:

a plurality of production tubings, a production tubing being disposed within each of said plurality of open holes and cemented in place therein; and at least one selectively-openable sliding valve located along each of said production tubings at a predetermined location and cemented permanently in place within one of said plurality of lateral open holes.

47. The selective fracing system of claim 46 further comprising a stinger on an outer end of each of said production tubings.

48. The selective fracing system of claim 47 wherein each of said at least one selectively-openable sliding valve is at least one of mechanically actuatable, hydraulically actuatable, and electrically actuatable.

49. A method of fracing at least one petroleum production zone through at least one open hole of an oil and/or gas well comprising:

locating a plurality of valves spaced apart along a production tubing at predetermined locations;

inserting said plurality of said valves and said production tubing into said at least one open hole;

cementing said plurality of said valves and said production tubing in place in said at least one open hole with cement, said predetermined locations along said production tubing corresponding to predetermined locations in said at least one open hole;

selectively opening said plurality of valves;

selectively removing some of said cement adjacent to said plurality of valves without using jetting or cutting tools to establish contact with said at least one petroleum production zone; and selectively fracing through said plurality of valves with fracing material.

* * * * *

UNITED STATES PATENT AND TRADEMARK OFFICE

CERTIFICATE OF CORRECTION

PATENT NO. : 7,926,571 B2
APPLICATION NO. : 11/760728
DATED : April 19, 2011
INVENTOR(S) : Raymond A. Hofman It is certified that error appears in the above-identified patent and that said Letters Patent is hereby corrected as shown below:

Title Page, Item (63), add the following:

-- Continuation-in-part of application ser. no. 11/079,950, filed Mar. 15, 2005, now Pat. No. 7,267,172. --

Column 1, Lines 7-11, delete the entire paragraph and substitute the following:

-- This application is a continuation-in-part application of U.S. Patent Application Ser. No. 11/079,950, filed Mar. 15, 2005, now U.S. Pat. No. 7,267,172, which is incorporated herein by reference. --

Claim 45, change the word “facing” to “fracing”

Signed and Sealed this
Thirtieth Day of October, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,926,571 B2
APPLICATION NO. : 11/760728
DATED : April 19, 2011
INVENTOR(S) : Raymond A. Hofman It is certified that error appears in the above-identified patent and that said Letters Patent is hereby corrected as shown below:

Title Page, Item (63), add the following:

-- Continuation-in-part of application ser. no. 11/079,950, filed Mar. 15, 2005, now Pat. No. 7,267,172. --

Column 1, Lines 7-11, delete the entire paragraph and substitute the following:

-- This application is a continuation-in-part application of U.S. Patent Application Ser. No. 11/079,950, filed Mar. 15, 2005, now U.S. Pat. No. 7,267,172, which is incorporated herein by reference. --

Column 17, line 8 (Claim 45, line 2) change the word “facing” to “fracing”

This certificate supersedes the Certificate of Correction issued October 30, 2012.

Signed and Sealed this
Fourth Day of December, 2012

David J. Kappos

David J. Kappos
*Director of the United States Patent and Trademark Office*